US005944953A

United States Patent [19]

Lavoie et al.

[11] Patent Number: 5,944,953

[45] **Date of Patent: *Aug. 31, 1999**

[54] PROCESS FOR SIMULTANEOUS MECHANICAL AND CHEMICAL DEFIBRATION OF CORN STALKS AND STRAW MATERIALS

[75] Inventors: Pierre Lavoie, Cap-de-la-Madeleine; Dennis Mondor, Grand-Mère; Jean Paradis, Cap-de-la-Madeleine; Daniel Thibautot, Nicolet; Isabelle Gagne, Cap-de-la-Madeleine; Marco Pelletier, Ville Dégelis, all of Canada

[73] Assignee: Le Centre Specialise en Pates et Papiers (CSPP) du College D'Enseignement General et Professionnel de Trois-Riveres, Quebec, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/614,244

[22] Filed: Mar. 12, 1996

[51] Int. Cl.[6] ..... D21H 11/12

[52] U.S. Cl. ..... 162/96; 162/97; 162/99; 162/26

[58] Field of Search ..... 162/96, 97, 98, 162/99, 81, 90, 83, 76, 26

[56] References Cited

U.S. PATENT DOCUMENTS

| | | | |
|---|---|---|---|
| 1,845,487 | 2/1932 | Darling | 162/96 |
| 2,625,474 | 1/1953 | Atkinson et al. | 162/96 |
| 2,924,547 | 2/1960 | Knapp et al. | 162/96 |
| 3,666,620 | 5/1972 | Wright | 162/96 |
| 4,260,452 | 4/1981 | Kruger et al. | 162/88 |

*Primary Examiner*—Stanley S. Silverman
*Assistant Examiner*—Dean T. Nguyen
*Attorney, Agent, or Firm*—Londa and Traub LLP

[57] ABSTRACT

A corn stalk and straw chip pulping method to greatly improve the yield of pulp by 1) preconditioning the corn stalk with propionic acid when harvesting or by impregnating the straw with $HNO_2$ in the mill after chip washing, and 2) by pulping the stalk or straw chips in a high-consistency pulper with a KOH liquor, with or without $K_2SO_3$, at a 12 to 15 percent consistency at 90° C. for a predetermined time period (30 to 60 minutes). The pulping improvement step increases the yield of corn stalk and straw pulp from approximately 40 percent to 70 to 75 percent.

4 Claims, 1 Drawing Sheet

PROCESS FOR SIMULTANEOUS MECHANICAL AND CHEMICAL DEFIBRATION OF CORN STALKS AND STRAW MATERIALS

BACKGROUND OF THE INVENTION

1. Field of the Invention

This invention relates to a pulping process to produce pulps used to make paper or paperboard from corn stalks (or other stalks), cereal straws (wheat, barley, rye, oat, etc.), other grasses, and flax or hemp. This is a high yield chemi-mechanical pulping process.

2. Description of the Prior Art

Softwoods, hardwoods, and non-wood plants such as bamboo, bagasse, rice, and wheat straws have been used in the prior art to produce paper pulps used in the world pulp and paper industry. The use of corn stalk to obtain useful fibers for the pulp and paper industry is also known. In the past, the conventional pulping process commonly used with corn stalks gives yields below 45 percent. Similar yields were obtained with straws and grasses.

Notwithstanding that non-wood fibers are typically shorter and more brittle papermaking fibers than softwood fibers (3–5 mm) and, as disclosed in the prior art, that the yield per weight of dry fiber obtained with the current pulping processes for those plants tends to be low, the availability by geographical distribution of those plants is so broad that it makes it possible to consider their use in paper pulps. Typically, corn stalks and corn husks produce fiber pulps from 1 to 2 mm in length, hardwoods produce fibers from 0.8 to 1.5 mm in length. Flax and true hemp produce bast fibers 20 to 25 mm in length, but they require special fiber treatment after cooking (heating).

Once a plant has been selected, such as corn stalk, the plant material must first be cooked or processed through a stage called pulping to remove extraneous materials such as sugars, starches, wax, and most important, lignin. Lignin essentially has to be dissolved because it is a glue-like substance that holds the fibers together. In order to provide for a usable fiber product from the pulping stage, the part of the lignin is dissolved and eventually removed. Then, the fiber is post-treated (screened, bleached, and lightly refined) to make it suitable for papermaking.

Prior to the chemical cooking process, wherein most of the lignin is dissolved and removed, it is important to prepare the specific material, such as corn stalk, to the proper size. Typically, whether it is wood or corn stalk, the material is cut into small chips, preferably between ¼ inch to 1 inch square, and no longer than 1 inch in any one dimension (in the case of wood only, ⅛ inch thick).

In a conventional corn stalk pulping and bleaching process, the corn stalks are cut into small pieces, typically approximately 1 inch in any one dimension, and screened to sort the chips by size to retain those chips below and over a certain size. Once sorted by size, the chips are washed and then passed to a steaming vessel where air is driven out of the chips by raising the temperature up to 240° F., allowing a cooking liquor to impregnate the chips. The chips pass from the steaming vessel into a high-pressure feeder. Chips and liquor are mixed as the chips are conveyed to the top of a digester. The top section of the digester is pressurized to 160 psi and, as the chip mass passes downward, the cooking liquor (usually soda (NaOH) or neutral sulfite ($Na_2SO_2$+NaOH)) penetrates into the chips. After about 45 minutes, the chips have passed through the impregnation zone and reach a heating zone where the hot liquor (340° F.) is recirculated through the chips for heating. The actual pulping wich is a delignification process occurs at about 335° F., in about 90 minutes, in the next zone coming which is called the cooking zone. The pulp is continuously blown from the digester to a diffusion washer where pulp washing is completed. In a conventional pulping process, the total elapsed time from the time the chips enter the chip bin until they leave the digester as pulp can be about 5 hours.

There are also today some chemi-mechanical pulping processes that are used to convert stalks (bagasse) and straws (rice) into fiber pulps. Those processes use pressurized digesters (either continuous or batch) to cook the pulp and refiners to complete the fiber separation. The yields of those processes may range from 55 to 70 percent, using chemicals such as soda (NaOH), lime soda ($CaO_2NaOH$), or neutral sulfite ($Na_2SO_2$+NaOH).

The present invention provides a corn stalk pulping process that can increase the fiber yield of the pulping process up to an average of 75 percent, efficiently and economically. The pulping is done in a high-consistency pulper with the presence of caustic potash (KOH), with or without potassium sulfite ($K_2SO_2$) at a relatively low temperature and for a short duration. The Applicant has found that by utilizing this new high yield chemi-mechanical pulping process and preconditioning the corn stalks days before processing, the pulping stage is improved, and the yield of useful fibers from corn stalks (and other cereal straws or grasses) can increase dramatically from 40 up to 75 percent.

Besides, the pulp so produced shows an equal or better quality than commercial pulps on the marked (deinked pulp, kraft pulp from hardwood, BOTMP pulp from hardwood, groundwood, and most agripulps from bamboo and bagasse for example), in particular for its tensile strength, burst strength, and bulkiness (absorbency). Moreover, the type of chemical products used in the pulping process gives residual liquors with high fertilizing potential which are environment friendly.

Finally, no known high yield pulping process exists today for producing pulps from corn stalk (or corn stover, including corn husks) with paper properties comparing with hardwood kraft commercial pulps.

SUMMARY OF THE INVENTION

The invention consists of an improved corn stalk pulping process for separating fibers in the corn stalk from extraneous materials such as lignin, in order to provide fibers for papermaking.

When harvesting the corn stalks in the field, propionic acid ($CH_3CH_2COOH$) is sprayed onto the stalks at a rate of 1.5 to 6 percent (based on dry matter of stalk) to help preserve them from mildew and fungus. The propionic acid eliminates the need to dry the stalks down to 15 percent moisture[1] with expensive drying systems in order to prevent the fiber from deterioration during the storage. It is believed that the propionic acid also interacts with lignins, by partially cutting down their molecular chains and so, allowing for a more efficient pulping process later on.

[1] Moisture content is the weight of water in the stalk, expressed as a percentage. For example, 100 pounds of corn stalk material at a 15 percent moisture (humidity) content means that there is 15 pounds of water in the material.

The impregnated corn stalks are cut into chips less than 1 inch in any dimension. Once the chips have been cut, the next step of the chip preparation process would be to screen the chips to insure that the average dimension of the chips is 1 inch in length. Those smaller than 3/16 inch are discarded and overs are rechipped in the same equipment that was used for chipping. After the screening process, the chips are washed in preparation for the pumping process stage, which is the important aspect of the invention.

In a high consistency pulper, a predetermined quantity of washed corn stalk chips are placed with a predetermined quantity of hot water at 60° C. The mixture is heated during approximately 30 minutes up to 90° C. while the pulper rotor is revolving, and the consistency of the chips is adjusted to reach a final level of 12 to 15 percent.[2] Then, KOH is added (at a rate of 10 to 15 percent based on dry matter of stalk) and $K_2SO_3$ (at a rate of 1 to 5 percent based on dry matter) in the pulper and the mixing operation is allowed to go on for 30 to 60 minutes. During this time, the dissolution action of the lignin by the KOH combined with the shearing action generated in the pulp mass by the revolving rotor (which can be a helico type) helps to separate the fibers within the chips without damaging them.

[2] Consistency is the weight of pulp fibers in a pulp suspension, expressed as a percentage. For example, 1 pound of pulp in 100 pounds of mixture (pulp and water) would be a pulp suspension of 1 percent consistency.

Utilizing the compounds listed above at those proportions, Applicant has found that by pulp consistencies, temperature, chemical concentrations, and mixing times, the result is a larger yield of fiber pulp, in the range of 70 to 75 percent, as opposed to prior methods where less than 45 percent was a typical yield.[3]

[3] The pulping yield represents the percentage of dry pulp produced from a given weight of dry stalk. For example, a pulp yield of 75 percent means that we process 100 pounds of stalk (measured on a dry basis) and we obtain 75 pounds of pump (also measured on a dry basis). The remaining 25 percent solids contained in residual liquors or sludge.

In an alternate embodiment, Applicant has found that air-dry stalks and cereal straws (wheat, barley, rye, etc) which would not have been previously treated with propionic acid could as well be preconditioned, once chopped down to 1 inch in length and screened, with a solution of nitric acid ($HNO_2$). This solution would be added after the washing stage at a rate of 0 to 3 percent (based on dry matter) for 15 to 60 minutes, at 50 to 60° C. Then, the impregnated chips are rinsed to eliminate most of the acid and they are conveyed to the pulper. Pulping is done in the same way as for corn stalk (see description above).

After the impregnation and pulping stages, the remaining stages are conventional in preparing the pulp. They are cleaning, washing, refining, screening, and, finally, bleaching.

It is an object of this invention to provide an improved corn stalk pulping process with a higher yield inexpensively and efficiently.

It is another object of this invention to provide an improved pulping process for stalks or straws, including wheat, barley, rye, rice, switchgrass, fescue, flax, and hemp that increase the fiber yield to between 70 and 75 percent.

In accordance with these and other objects which will become apparent hereinafter, the instant invention will now be described with particular reference to the accompanying drawings.

DESCRIPTION OF THE PREFERRED EMBODIMENT

Figure 1:
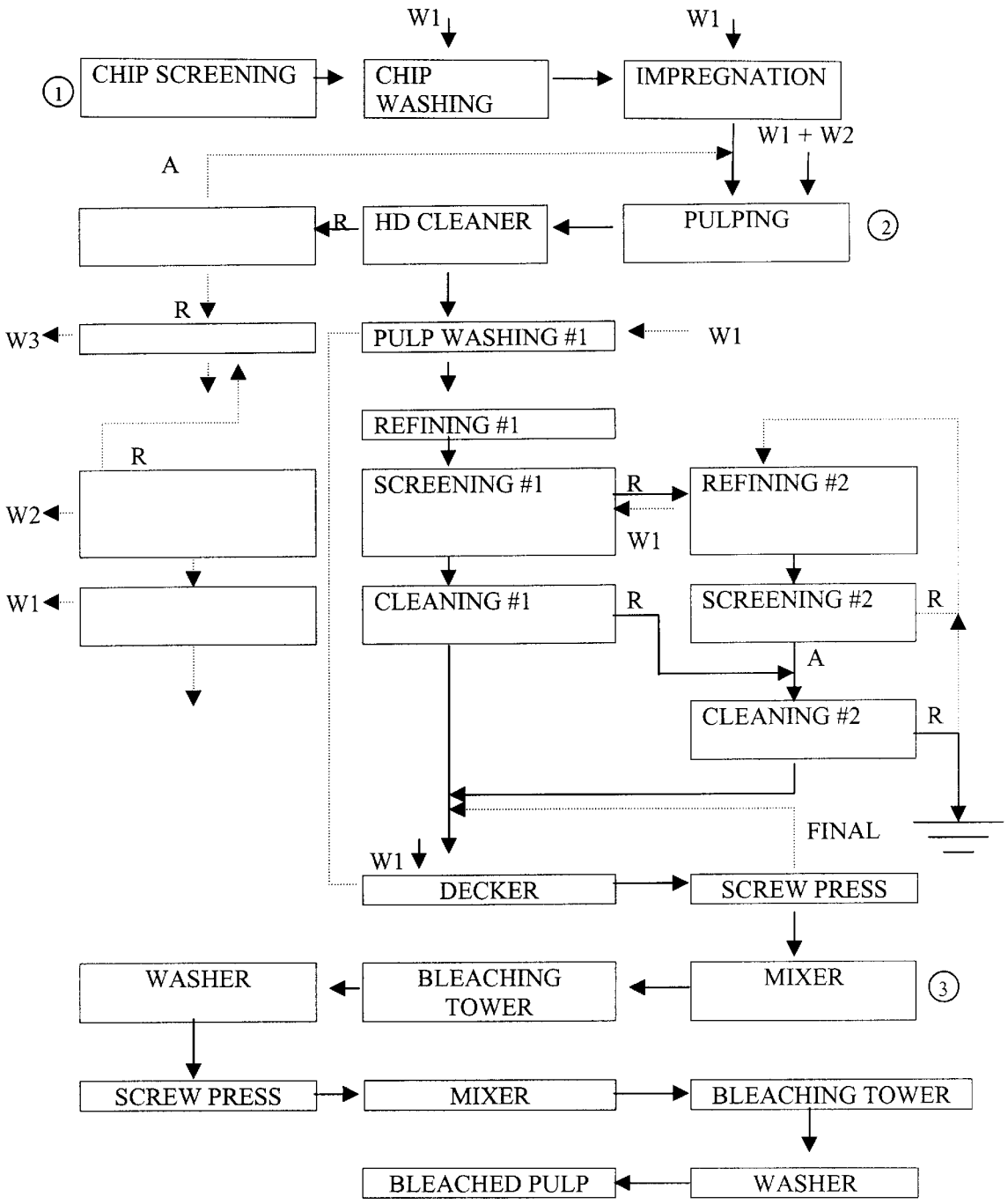
FIG. 1 shows the flow chart for the high-consistency pulping and bleaching process as applied to corn stalk. The invention resides in step 2, pulping, which is described herein.

An improved pulping process for obtaining fiber pulp useful in the manufacture of paper products from plants such as corn stalks. This process involves the separation of the fibers one from each other and extraction of other extraneous materials contained in the stalks and the straws. The specific invention relates to preconditioning the stalks by impregnation and pulping, wherein the particular fibrous material is processed and cooked to dissolve part of the lignin and separate the fibers one from each other.

When harvesting corn stalks are sprayed in the field with a 1.5 to 6 percent propionic acid ($CH_3CH_2COOH$) solution to preserve the stalks and prevent mildew or fungus. This solution also serves to precondition the stalks for future processing.

EXAMPLE 1

Corn Stalk

After impregnation in the field with propionic acid, corn stalks are prepared by chopping the stalks into chips, preferably from 3/16 inch thickness to 3/4 inch thickness, and not exceeding 1 inch in any one dimension. The corn stalk chips are then screened by size so that pieces larger than 1 inch or smaller than 3/16 inch are removed. The chips are thoroughly washed in preparation for the next steps in the procedure. A predetermined quantity of chips, such as 6,000 pounds (on a dry basis) of corn stalk chips is placed in the pulper with a quantity of water such that the final consistency of the mixture will be 12 to 15 percent. Then the mixture is heated up to 90° C. during a minimum of 30 minutes or until the maximum temperature has been reached; this will allow to drive the air out of the chips to ease the impregnation. When the temperature is reached, the KOH solution, with or without $K_2SO_3$, is added, and we keep mixing at this temperature for 30 to 60 more minutes. After the pulping treatment, the pulp is washed and treated in a series of conventional steps: high density (HD) cleaner, washer, refiner, screen, and cleaner. All of these additional steps of the pulp treatment are conventional and chosen to reach the required characteristics of the pulp produced. They are also preparatory for the bleaching of the pulp, which can be conventional.

Along with corn stalks, it is believed that usable fiber pulps can also be obtained from other non-wood materials, such as wheat straw (oat, barley, rye, rice), flax, and hemp, which may be treated and preconditioned before the pulping stage.

EXAMPLE

Wheat Straw

Once chopped down to 1 inch in length and screened, wheat straw which has not previously been treated with propionic acid can be preconditioned with a solution of nitric acid ($HNO_2$). This solution is added after the washing stage, at a rate of 0 to 8 percent (based on dry matter), for 15 to 60 minutes, at 50 to 60° C. The, the impregnated chips are rinsed to eliminate most of the acid and conveyed to the pulper, where pulping is done as for corn stalk, as follows:

A predetermined quantity of chips, such as 6,000 pounds (on a dry basis) of wheat straw chips is placed in the pulper with a quantity of water such that the final consistency of the mixture will be 12 to 15 percent. Then the mixture is heated up to 90° C. for a minimum of 30 minutes or until the maximum temperature has been reached. When the temperature is reached, the KOH solution, with or without $K_2SO_3$ is added, and we keep mixing at this temperature for 30 to 60 more minutes. After the pulping treatment, the pulp is washed and treated in a series of conventional steps: high density (HD) cleaner, washer, refiner, screen, and bleaching as shown in the flow diagram hereinafter.

CONCLUSION

Applicant has found that by preconditioning corn stalks in the field or impregnating straw chips in the mill, and by pulping those stalks or chips as discussed in Examples 1 and 2, a pulp of a better quality with a yield of 70 to 75 percent can be obtained, wherein previously yields were less than 45 percent.

The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. A method of producing pulp fibers harvested from corn stalks, comprising a pre-bleaching process followed by a bleaching process, the pre-bleaching process consisting essentially of the steps of:

(a) impregnating said harvested corn stalks with a solution of $CH_3CH_2COOH$ when harvesting to precondition the corn stalks;

(b) chopping the preconditioned corn stalks into chips not exceeding approximately 1 inch in any one dimension, screening the chopped corn stalk chips to insure that the chips do not exceed 1 inch in any one dimension, and washing the chopped chips;

(c) conveying the washed corn stalk chips in a pulper with water at about 60° C. to form a mixture with a consistency of 12 to 15 percent, and heating the mixture to 90° C. for at least 30 minutes while the mixture is revolving in said pulper using a rotor;

(d) adding 10 to 15 weight percent of KOH, based on dry matter of corn stalk chips, to the mixture in said pulper; and (e) treating the mixture of step (d) in the pulper at 90° C. for 30 to 60 minutes under the shearing action generated by the revolving rotor so as to produce pulp fibers, wherein the pre-bleaching process is followed by a bleaching step without an intervening alkaline extraction step.

2. A straw pulping process for obtaining fiber pulp from harvested straw, comprising a pre-bleaching process followed by a bleaching process, the pre-bleaching process consisting essentially of the steps of:

(a) chopping the harvested straw into chips not exceeding 1 inch in any one dimension, screening said chopped straw chips to insure that the chopped straw chips do not exceed 1 inch in any one dimension, and washing the chopped straw chips;

(b) impregnating the chopped straw chips with a $HNO_2$ solution at a rate of 1 to 3 percent based on dry matter of straw chips and rinsing the impregnated chips;

(c) conveying said impregnated straw chips in a pulper with water at about 60° C. to form a mixture having a consistency of 12 to 15 percent, and heating the mixture to 90° C. for at least 30 minutes while the mixture is revolving in said pulper using a rotor;

(d) adding 10 to 15 weight percent of KOH, based on dry matter of straw chips, to the mixture in said pulper; and (e) treating the mixture of step (d) in the pulper at 90° C. for 30 to 60 minutes under the shearing action generated by the revolving rotor so as to produce pulp fibers, wherein the pre-bleaching process is followed by a bleaching step without an intervening alkaline extraction step.

3. A method of producing pulp fibers harvested from corn stalks, comprising a pre-bleaching process followed by a bleaching process, the pre-bleaching process consisting essentially of the steps of:

(a) impregnating said harvested corn stalks with a solution of $CH_3CH_2COOH$ when harvesting to precondition the corn stalks;

(b) chopping the preconditioned corn stalks into chips not exceeding approximately 1 inch in any one dimension, screening the chopped corn stalk chips to insure that the chips do not exceed 1 inch in any one dimension, and washing the chopped chips;

(c) conveying the washed corn stalk chips in a pulper with water at about 60° C. to form a mixture with a consistency of 12 to 15 percent, and heating the mixture to 90° C. for at least 30 minutes while the mixture is revolving in said pulper using a rotor;

(d) adding 10 to 15 weight percent of KOH and 1 to 5 weight percent $K_2SO_3$, both based on dry matter of corn stalk chips, to the mixture in said pulper; and (e) treating the mixture of step (d) in the pulper at 90° C. for 30 to 60 minutes under the shearing action generated by the revolving rotor so as to produce pulp fibers, wherein the pre-bleaching process is followed by a bleaching step without an intervening alkaline extraction step.

4. A straw pulping process for obtaining fiber pulp from harvested straw, comprising a pre-bleaching process followed by a bleaching process, the pre-bleaching process consisting essentially of the steps of:

(a) chopping the harvested straw into chips not exceeding 1 inch in any one dimension, screening said chopped straw chips to insure that the chopped straw chips do not exceed 1 inch in any one dimension, and washing the chopped straw chips;

(b) impregnating the chopped straw chips with a $HNO_2$ solution at a rate of 1 to 3 percent based on dry matter of straw chips and rinsing the impregnated chips;

(c) conveying said impregnated straw chips in a pulper with water at about 60° C. to form a mixture having a consistency of 12 to 15 percent, and heating the mixture to 90° C. for at least 30 minutes while the mixture is revolving in said pulper using a rotor;

(d) adding 10 to 15 weight percent of KOH and 1 to 5 weight percent $K_2SO_3$, both based on dry matter of straw chips, to the mixture in said pulper; and (e) treating the mixture of step (d) in the pulper at 90° C. for 30 to 60 minutes under the shearing action generated by the revolving rotor so as to produce pulp fibers, wherein the pre-bleaching process is followed by a bleaching step without an intervening alkaline extraction step.

* * * * *